US006840314B2

(12) United States Patent
Rivis et al.

(10) Patent No.: US 6,840,314 B2
(45) Date of Patent: Jan. 11, 2005

(54) CONDENSER FOR DOMESTIC REFRIGERATOR CABINETS AND A DOMESTIC REFRIGERATOR CABINET PROVIDED WITH SUCH A CONDENSER

(75) Inventors: Enzo Rivis, Biandronno (IT); Giuseppe Panighini, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 30 days.

(21) Appl. No.: 10/264,613

(22) Filed: Oct. 4, 2002

(65) Prior Publication Data

US 2003/0085029 A1 May 8, 2003

(30) Foreign Application Priority Data

Oct. 18, 2001 (IT) ..... VA2001A0037

(51) Int. Cl.[7] ..... F25B 39/04; F28F 3/12
(52) U.S. Cl. ..... 165/170; 62/507
(58) Field of Search ..... 165/170, 171; 62/507; 29/590.039, 590.041, 590.042

(56) References Cited

U.S. PATENT DOCUMENTS

| | | | | | |
|---|---|---|---|---|---|
| 2,064,141 | A | * | 12/1936 | Askin | 29/890.035 |
| 2,071,182 | A | | 2/1937 | Steenstrup | 257/36 |
| 2,189,494 | A | | 2/1940 | Kucher | 62/116 |
| 2,471,960 | A | | 5/1949 | Johnson | 257/36 |
| 2,514,469 | A | * | 7/1950 | Burkhardt | 29/890.042 |
| 2,585,736 | A | | 2/1952 | Burr | 62/103 |
| 2,595,472 | A | | 5/1952 | Larkin | 257/256 |
| 2,626,130 | A | * | 1/1953 | Raskin | 165/170 |
| 3,046,758 | A | * | 7/1962 | Heuer et al. | 62/426 |
| 3,240,269 | A | * | 3/1966 | Thomas | 165/170 |
| 3,406,750 | A | | 10/1968 | Pauls | 165/148 |
| 4,227,571 | A | * | 10/1980 | Tjaden | 165/167 |
| 5,353,868 | A | * | 10/1994 | Abbott | 165/171 |
| 5,946,939 | A | * | 9/1999 | Matsushima et al. | 62/507 |
| 6,050,330 | A | | 4/2000 | Schmit | 165/133 |

FOREIGN PATENT DOCUMENTS

| | | | |
|---|---|---|---|
| EP | 0756142 A2 | 1/1997 | F25B/39/00 |
| EP | 0843138 A1 | 5/1998 | F25D/11/02 |

* cited by examiner

*Primary Examiner*—Allen J. Flanigan
(74) *Attorney, Agent, or Firm*—Robert O. Rice; John P. Colligan; Stephen Krefman

(57) ABSTRACT

The present invention relates to a condenser for a domestic refrigerator having channelling which provides for the passage of a refrigerant associated with a substantially flat metal surface suitable for ensuring heat exchange between the refrigerant and air. The condenser comprises two plates configured to face each other, at least one of the plates being provided with a shaped groove configured to provide channelling which provides passage for the refrigerant.

11 Claims, 1 Drawing Sheet

CONDENSER FOR DOMESTIC REFRIGERATOR CABINETS AND A DOMESTIC REFRIGERATOR CABINET PROVIDED WITH SUCH A CONDENSER

BACKGROUND OF THE INVENTION

1. Field of the Invention

The present invention concerns a condenser for domestic refrigerator cabinets, of the type comprising channelling for the passage of a refrigerant associated with a substantially flat metal surface in order to increase the heat exchange between the refrigerant and the air. As used herein, the term "refrigerator cabinet" refers to any type of domestic refrigerator or freezer.

2. Description of the Related Art

The static condensers used today in domestic refrigeration are essentially of two types: plate-type and wire-type. The first type is that referred to at the start of the description. Both types have the drawback of having a primary surface (tube) and a secondary surface (plate or wires) that are joined to the primary one by stapling or welding (therefore contact is made at only a few points, with a consequent loss of temperature and hence efficiency).

Furthermore, recent experiments made by Applicants on condensers have surprisingly demonstrated the great importance of mass in this type of heat exchanger.

The aim of the present invention is therefore that of providing a condenser that does not have the aforementioned drawbacks, for which a substantial energy saving can be guaranteed, while remaining simple and economic to produce.

SUMMARY OF THE INVENTION

According to the invention, this aim is achieved by the fact that the condenser comprises two metal plates facing each other and joined together by welding or brazing, at least one of said plates being provided with a shaped groove capable of constituting said channelling for the passage of the refrigerant.

Because of these characteristics it is possible to improve optimal heat exchange between the hot refrigerant and the material constituting the plate. Furthermore, with the solution according to the invention it is possible to use a plate of greater thickness, and there is no need to ensure good shaping of the plate in the area of the tubes (as required by current plate-type condensers). In fact, the plate condensers used nowadays have a thickness of 0.3–0.4 mm, whereas in the solution according to the invention the condenser is formed by two plates of a thickness preferably comprised between about 0.2 mm and about 0.5 mm, more preferably between about 0.3 mm and about 0.4 mm, brazed or welded together, for which the total thickness is preferably comprised between about 0.6 mm and about 0.8 mm.

One of the advantages of the solution according to the invention is that the solution improves efficiency through better contact. The primary surface (tube) and the secondary surface (plate) of traditional plate condensers are all the same in that they are two plates, a smooth flat one and a flat one with funnelled channelling in the form of grooves brazed or welded together, with contact over the whole surface except in the area of the shaped grooves.

Additionally, the solution improves efficiency because of the closeness of the channels. Current condensers have an inter-tube pitch of 50–60 mm. This distance was once considered to be optimal, as a fair compromise between cost and performance. In the solution according to the invention (the channelling being produced by pressing), the number of channellings does not alter the cost of the component by which it can be produced so as to optimise performance. An inter-channel pitch of between about 20 and about 50 mm, preferably between about 30 and about 40 mm, has improved efficiency of exchange, particularly with a horizontal lying position of the parallel rectilinear portions of the conduits (connected by curvilinear portions for the production of the coil), with reference to the usage configuration of the condenser arranged on an outer wall of the refrigerator cabinet.

Another advantage of the solution is improved efficiency through greater mass of the condenser. As stated above, current plate-type condensers typically have a thickness of 0.3–0.4 mm, which is a limit for this type of technology. With the solution according to the invention it is possible also to have thicknesses of about 0.8 mm and therefore double the weight (for the same surface area). On the basis of tests carried out, a thickness of between about 0.6 mm and about 0.8 mm proves to be more optimal.

Another advantage is the possibility of providing L-shaped side folds in the plate, in order to obtain the desired dimension of the "chimney", and of having prepositioning, for fixing to the product without using other components (as is necessary in some plate-type solutions and for the wire-type version). The term "chimney" refers here to the portion of space comprised between the condenser and the rear wall of the refrigerator cabinet, suitable for directing the hot air upwards by convective motion.

On the basis of the tests carried out, the applicant has found that, in order to improve efficiency further, the solution according to the invention requires a section of the channelling preferably comprised between about 6 $mm^2$ and about 14 $mm^2$, more preferably comprised between about 8 $mm^2$ and about 12 $mm^2$.

According to another characteristic of the invention, the condenser can advantageously be provided with finning between the channelling, which permits better circulation of air between the two sides of the condenser. The optimal height of the fins is comprised between about 3 mm and about 12 mm, preferably between about 5 mm and about 10 mm.

In another embodiment of the invention it is possible to braze in a furnace, together with the two plates, also the two tubes for connection to the remainder of the circuit (compressor and filter). This will make it possible to have better quality (elimination of two welds) and lower cost of the condenser.

BRIEF DESCRIPTION OF THE DRAWINGS

Further advantages and characteristics of a condenser according to the present invention will become apparent from the following detailed description, provided purely by way of non-exhaustive example, with reference to the attached drawings in which.

DETAILED DESCRIPTION

Figure 1:
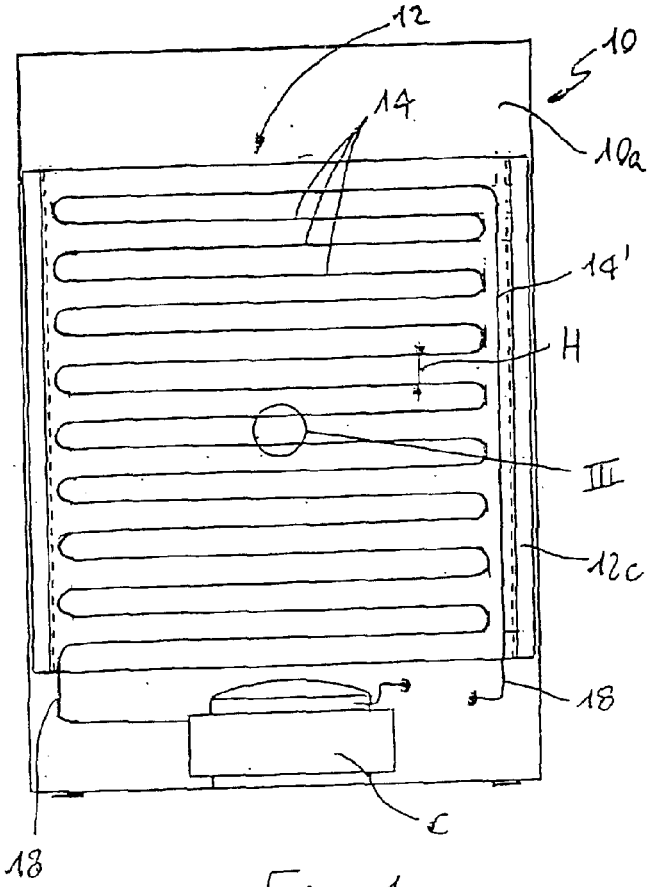
FIG. 1 is a view of the condenser in one configuration thereof installed on a domestic refrigerator.
Figure 2:
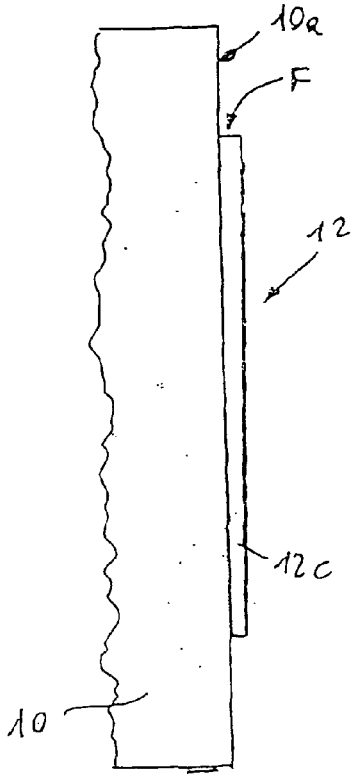
FIG. 2 is a side view of the condenser in FIG. 1.

With reference to the drawings, the reference numeral 10 illustrates a domestic refrigerator provided, on a rear wall thereof 10*a*, with a condenser 12 configured to receive hot refrigerant coming from a compressor C, of liquefying it gradually and of sending it, cooled, to an evaporator (not illustrated) of the refrigerant circuit. The condenser 12 is constituted by two metal plates 12*a* and 12*b* made of iron or steel (FIGS. 4 and 5) brazed together in a furnace (for example, using a copper-based brazing alloy) and each having a thickness of about 0.4 mm. One of the two plates, in the example illustrated in the drawing the plate 12*b*, has a shaped groove 14 made for example by pressing, which covers substantially the whole flat surface of the condenser along a coiled path. In particular, downstream from the compressor C the refrigerant enters the bottom of the channelling defined by the groove 14 and flows, horizontally and back and forth, over the flat surface of the condenser until it reaches the top. From there, through a vertical groove 14', it is directed towards the lower portion of the condenser, from where it is then sent subsequently to the evaporator.

The vertical distance H between two parallel lengths of the groove is, in the example illustrated, comprised between about 30 mm and about 40 mm. The condenser 12 has at the side two L-shaped folded edges 12*c* that are capable of defining both the portions for joining (for example by screwing) to the rear wall 10*a* of the refrigerator 10 and, together with said wall, a channel F generally known as a "chimney" suitably inclined and suitable for favouring the circulation of air by convective motion in relation to the condenser 12.

Figure 3:
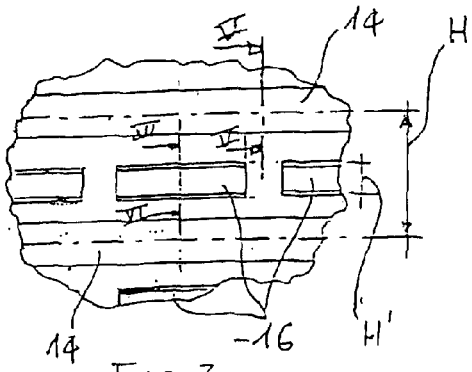
FIG. 3 is a detail from FIG. 1, which illustrates the finning of the condenser.
Figure 4:
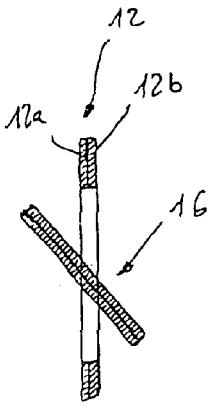
FIG. 4 is a view in section along the line IV—IV in FIG. 3, on a larger scale.
Figure 5:
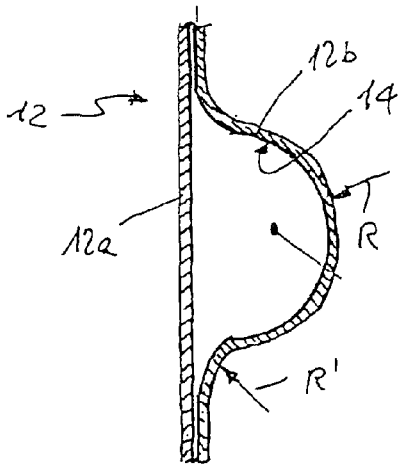
FIG. 5 is a view in section, along the line V—V, in FIG. 3.

In order to increase heat exchange, the surfaces of the condenser comprised between the parallel rectilinear lengths of the groove 14 are provided with fins 16 made by partial cutting of the plates 12*a* and 12*b* and subsequent bending (FIGS. 3 and 4). Tests carried out by the Applicants have demonstrated that the optimal height H' of the fins is comprised between about 5 mm and about 10 mm, with a length of between about 20 mm and about 40 mm, although this latter characteristic is not particularly critical and is dictated by the exigencies of practical production of the fins.

The groove 14 of the condenser 12 has an optimal section of passage of between about 8 $mm^2$ and about 12 $mm^2$, with a depth of between about 2.1 mm and about 3.2 mm, a main radius R (FIG. 5) of between about 1.5 mm and about 2 mm and a secondary radius R' (for connection to the flat plate 12*a* of the condenser) of between about 0.5 mm and about 1 mm.

In relation to the connections to the compressor C and to the remainder of the refrigerant circuit, the condenser 12 may be provided with small connecting tubes 18 joined to the condenser itself during the process of brazing or welding the two plates 12*a* and 12*b*.

EXAMPLE

Tests have been carried out on a prototype condenser as described and illustrated, with a 10 $mm^2$ section of channelling and a pitch between the horizontal lengths of channelling equal to 35 mm. The condenser was installed on the Whirlpool RE 160 AUT model refrigerator produced by the applicant, from which the traditional type of plate condenser was removed for preventive reasons. The tests were repeated, in identical conditions, on a commercial Whirlpool refrigerator of the same model. The tests gave the following results:

| | Traditional condenser | Condenser of the invention |
|---|---|---|
| Compartment temp. | +5° C. | +5° C. |
| Condenser temp | 43.8° C. | 40.6° C. |
| Consumption (Wh/24 h) | 558 | 539 |
| Variation (%) | | (−3.4%) |

Therefore, for the same temperature inside the refrigerator, there was a 3.4% lower consumption, thanks to a lowering of the condensation temperature by 3.2° C. obtained with the condenser according to the invention.

Naturally, variants of the condenser according to the invention are possible. For example, the groove can be produced on both the plates so that the channelling is made in the space between the grooves facing each other; in this configuration the channelling has a substantially circular cross-section. Furthermore, the material of the plates can also vary, although the choice of iron or steel has a more advantageous effect both in terms of energy efficiency and in terms of reduced costs.

We claim:

1. A condenser for a domestic refrigerator cabinet, the condenser comprising:

two plates configured to face each other, at least one of the plates comprising a serpentine groove that forms a serpentine channelling when the two plates are in facing relationship to provide a passage for refrigerant to effect heat exchange between the refrigerant and air, the serpentine groove comprises horizontal rectilinear lengths connected together by curvilinear lengths, the pitch between the rectilinear lengths is between about 20 mm and 50 mm, and the channelling has a cross-sectional area between about 6 $mm^2$ and about 14 $mm^2$.

2. The condenser according to claim 1, wherein the two plates each have a thickness greater than 0.25 mm.

3. The condenser according to claim 1, wherein the two plates are joined together by one of the following: welding and brazing.

4. The condenser according to claim 1, wherein the two plates are metal.

5. The condenser according to claim 2, wherein the plates each have a thickness of greater than 0.25 mm and less than 0.5 mm.

6. The condenser according to claim 1, wherein the two plates further comprise inclined fins positioned between the rectilinear lengths of the channelling and configured to increase the heat exchange of the condenser.

7. The condenser according to claim 6, wherein the inclined fins are cut and plastically deformed from portions of the two plates.

8. The condenser according to claim 6, wherein the fins have a height of between about 3 mm and about 12 mm.

9. The condenser according to claim 6, wherein each fin has a length of between about 20 mm and about 40 mm.

10. The condenser according to claim 1, further comprising tubular inlet and outlet connectors positioned between the plates at a portion of the channelling having entry and exit zones.

11. The condenser according to claim 10, wherein the tubular inlet and outlet connectors are attached to the plates in one of the following ways: inserted, welded and brazed.

* * * * *